US008515310B2

(12) United States Patent
Nakura et al.

(10) Patent No.: US 8,515,310 B2
(45) Date of Patent: Aug. 20, 2013

(54) PRESSING MECHANISM, TRANSFER DEVICE, AND IMAGE FORMING APPARATUS

(75) Inventors: Makoto Nakura, Ibaraki (JP); Hiroshi Suzuki, Ibaraki (JP); Hirofumi Ohkushi, Ibaraki (JP); Junji Shirakawa, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 596 days.

(21) Appl. No.: 12/403,853

(22) Filed: Mar. 13, 2009

(65) Prior Publication Data

US 2009/0245864 A1 Oct. 1, 2009

(30) Foreign Application Priority Data

Mar. 26, 2008 (JP) ..... 2008-081231

(51) Int. Cl.
*G03G 15/08* (2006.01)

(52) U.S. Cl.
USPC ..... 399/121; 399/302; 399/313

(58) Field of Classification Search
USPC ..... 399/66, 121, 297, 302, 308, 310, 399/313, 318
See application file for complete search history.

(56) References Cited

U.S. PATENT DOCUMENTS

| | | | | |
|---|---|---|---|---|
| 4,260,237 | A * | 4/1981 | Nishikawa | 399/336 |
| 5,040,028 | A * | 8/1991 | Kamimura et al. | 399/302 |
| 5,175,589 | A * | 12/1992 | Kimura | 399/297 |
| 5,633,703 | A * | 5/1997 | Takenouchi et al. | 399/315 |
| 7,162,179 | B2 * | 1/2007 | Yoshida | 399/101 |
| 8,014,701 | B2 * | 9/2011 | Nakura et al. | 399/121 |
| 2004/0096248 | A1 * | 5/2004 | Tomizawa | 399/313 |
| 2006/0056884 | A1 * | 3/2006 | Sawai et al. | 399/302 |
| 2008/0232866 | A1 | 9/2008 | Shoji et al. | |
| 2008/0232879 | A1 | 9/2008 | Shoji et al. | |
| 2008/0240802 | A1 | 10/2008 | Nakura | |
| 2008/0240821 | A1 | 10/2008 | Shoji et al. | |
| 2008/0267673 | A1 | 10/2008 | Tao et al. | |
| 2008/0296828 | A1 | 12/2008 | Shoji et al. | |
| 2009/0060576 | A1 | 3/2009 | Tao et al. | |
| 2009/0060605 | A1 | 3/2009 | Ohkushi et al. | |
| 2009/0062048 | A1 | 3/2009 | Nakura | |
| 2009/0067892 | A1 | 3/2009 | Mikajiri et al. | |
| 2009/0245864 | A1 | 10/2009 | Nakura et al. | |

FOREIGN PATENT DOCUMENTS

| | | |
|---|---|---|
| JP | 63-208883 | 8/1988 |
| JP | 63-246773 | 10/1988 |
| JP | 9-255166 | 9/1997 |
| JP | 10-063120 | 3/1998 |
| JP | 10-240039 | 9/1998 |
| JP | 11-301052 | 11/1999 |
| JP | 2000-122445 | 4/2000 |

(Continued)

*Primary Examiner* — Walter L Lindsay, Jr.
*Assistant Examiner* — Benjamin Schmitt
(74) *Attorney, Agent, or Firm* — Oblon, Spivak, McClelland, Maier & Neustadt, L.L.P.

(57) ABSTRACT

A pressing mechanism that presses a contact unit, which is brought into contact with a contact target unit against the contact target unit, includes a holding unit that holds the contact unit. The holding unit includes two first portions that are arranged at both ends of the holding unit in its width direction away from the contact unit and are biased toward the contact target unit and a second portion that is arranged at approximately a center in the width direction sandwiching the contact unit with the first portions and supports the holding unit.

11 Claims, 6 Drawing Sheets

(56) References Cited

FOREIGN PATENT DOCUMENTS

| | | |
|---|---|---|
| JP | 2005-301216 | 10/2005 |
| JP | 3789292 | 4/2006 |
| JP | 2007-3578 | 1/2007 |
| JP | 2007-148196 | 6/2007 |
| JP | 2008-64819 | 3/2008 |

* cited by examiner

PRESSING MECHANISM, TRANSFER DEVICE, AND IMAGE FORMING APPARATUS

CROSS-REFERENCE TO RELATED APPLICATIONS

The present application claims priority to and incorporates by reference the entire contents of Japanese priority document 2008-081231 filed in Japan on Mar. 26, 2008.

BACKGROUND OF THE INVENTION

1. Field of the Invention

The present invention relates to a pressing mechanism for a transfer device in an image forming apparatus.

2. Description of the Related Art

A technology of using a pressing mechanism when transferring an image from an image carrier onto a recording medium is widely known in the field of an image forming apparatus such as a copier, a printer, a facsimile, and a multifunction peripheral thereof, such as one disclosed in Japanese Patent Application Laid-open No. 2007-148196. The pressing mechanism presses a contact unit such as a secondary transfer roller that is brought into contact with a contact target unit such as an intermediate transfer belt or a secondary transfer opposing roller.

In the image forming apparatus disclosed in Japanese Patent Application Laid-open No. 2007-148196, four photosensitive elements are aligned to oppose an intermediate transfer belt. Toner images of four different colors of black, yellow, magenta, and cyan are formed on the photosensitive elements, which are transferred onto the intermediate transfer belt in a superimposed manner. Then, the toner images formed on the intermediate transfer belt are transferred as a color image onto a recording medium such as a print sheet at a position where the intermediate transfer belt and the secondary transfer roller are brought into contact with each other.

In such image forming apparatus, a contact/separation mechanism is provided for bringing the secondary transfer roller into contact with the intermediate transfer belt and separating the secondary transfer roller from the intermediate transfer belt. The contact/separation mechanism enables a recording medium (sheet) jammed at a nip portion between the intermediate transfer belt and the secondary transfer roller to be removed easily and facilitates assembly and maintenance when the intermediate transfer belt and the secondary transfer roller are each configured to be detachable as a unit from the image forming apparatus. When the secondary transfer roller is in contact with the intermediate transfer belt (i.e., in normal times), the pressing mechanism presses the secondary transfer roller against the secondary transfer opposing roller with the intermediate transfer belt therebetween.

More specifically, in Japanese Patent Application Laid-open No. 2007-148196, the secondary transfer roller is held by a holding unit (auxiliary rotating unit). The holding unit is supported at three points, by the engagement of a reference pin with an insertion hole formed in an end portion of the holding unit in its width direction and the engagement by two coil springs provided on both end portions of the holding unit in the width direction. Under this condition, the secondary transfer roller is pressed against the intermediate transfer belt.

In the above technology, the secondary transfer roller is pressed against the intermediate transfer belt while being held by the three-point supported holding unit. Therefore, the secondary transfer roller is expected to be pressed against the intermediate transfer belt (or the secondary transfer opposing roller) in a relatively uniform manner in the width direction. However, even with such configuration, the pressure on the secondary transfer roller against the intermediate transfer belt does not always become even and varies in the width direction in some cases, which leads to unevenness in a toner image transferred onto a recording medium by the secondary transfer roller. This results in unevenness in density of an output image in the width direction, i.e., a direction perpendicular to a recording medium conveying direction.

The above problem is noticeable especially in an image forming apparatus capable of feeding a recording medium of a large width.

Moreover, the above problem is not limited to a pressing mechanism in which a secondary transfer roller is used as a contact unit and a secondary transfer opposing roller or an intermediate transfer belt is used as a contact target unit, and occurs to any pressing mechanism that presses a contact unit against a contact target unit.

SUMMARY OF THE INVENTION

It is an object of the present invention to at least partially solve the problems in the conventional technology.

According to one aspect of the present invention, there is provided a pressing mechanism that presses a contact unit that is brought into contact with a contact target unit against the contact target unit. The pressing mechanism includes a holding unit that holds the contact unit. The holding unit includes two first portions that are arranged at both ends of the holding unit in its width direction away from the contact unit and are biased toward the contact target unit; and a second portion that is arranged at approximately a center in the width direction sandwiching the contact unit with the first portions and supports the holding unit.

Furthermore, according to another aspect of the present invention, there is provided a transfer device that transfers a toner image from a first image carrier onto either one of a recording medium and a second image carrier, and includes a pressing mechanism that presses a contact unit that is brought into contact with a contact target unit against the contact target unit. The pressing mechanism includes a holding unit that holds the contact unit. The holding unit includes two first portions that are arranged at both ends of the holding unit in its width direction away from the contact unit and are biased toward the contact target unit; and a second portion that is arranged at approximately a center in the width direction sandwiching the contact unit with the first portions and supports the holding unit, and the contact unit is a transfer roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below in detail with reference to the attached drawings. The same or equivalent components are given the same numerals and the explanation thereof is simplified or omitted.

Figure 1:
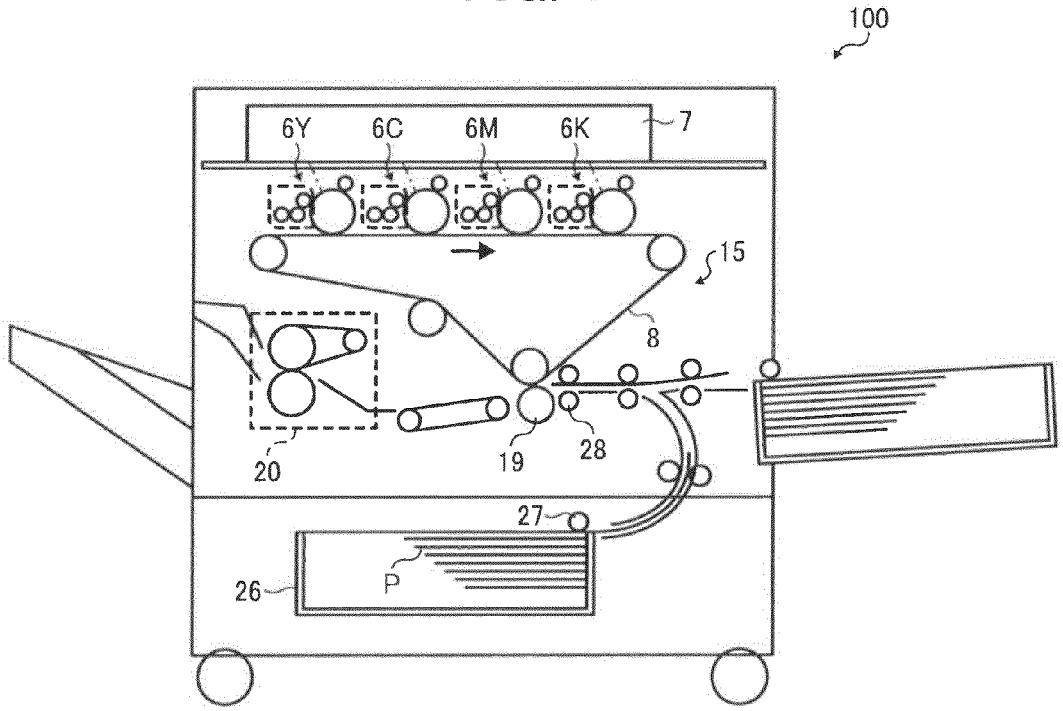
FIG. 1 is a schematic diagram of an image forming apparatus according to an embodiment of the present invention.
Figure 2:
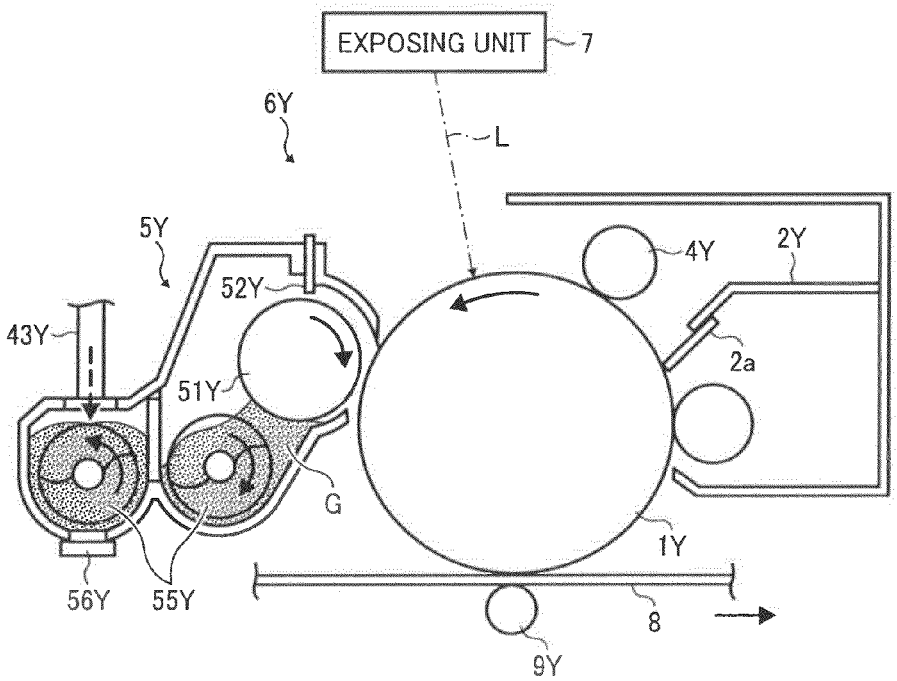
FIG. 2 is a schematic diagram of an imaging unit of the image forming apparatus.
Figure 3:
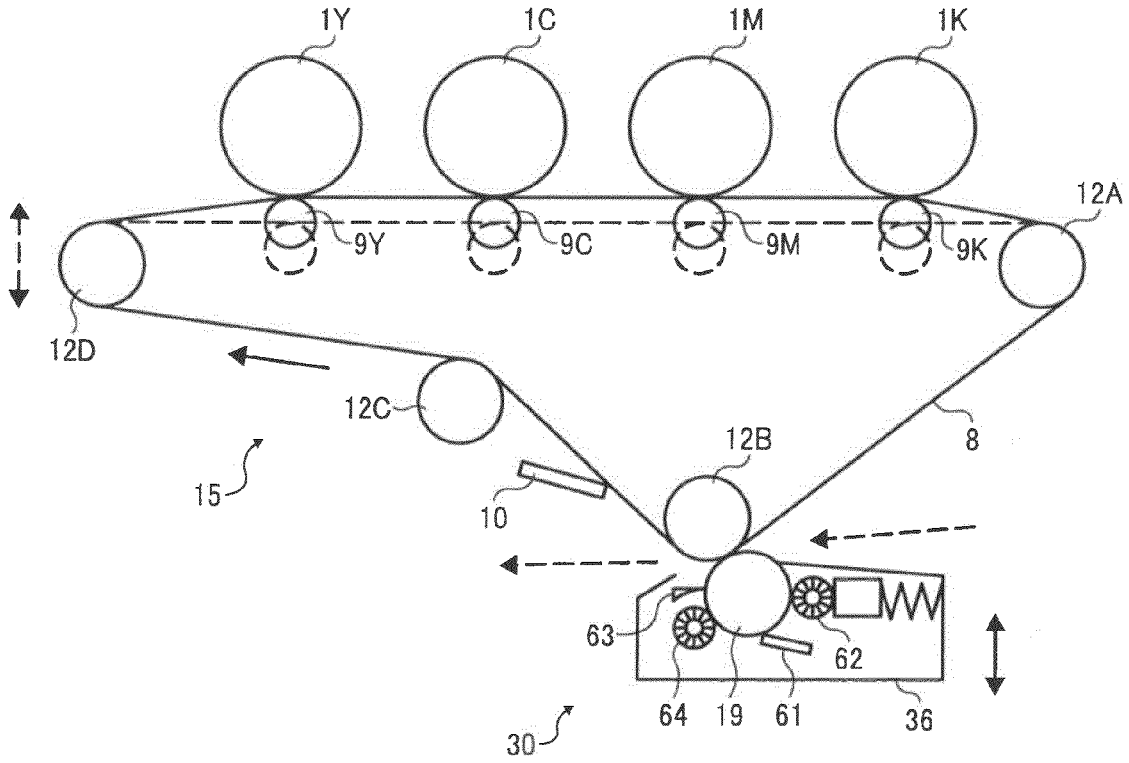
FIG. 3 is a schematic diagram of an intermediate transfer belt device of the image forming apparatus.

FIG. 1 is a schematic diagram of an image forming apparatus 100; FIG. 2 is a schematic diagram of an imaging unit 6Y of the image forming apparatus 100; and FIG. 3 is a schematic diagram of an intermediate transfer device 15 of the image forming apparatus 100.

As shown in FIG. 1, the intermediate transfer device 15 is arranged inside the image forming apparatus 100. Imaging units 6Y, 6M, 6C, and 6K corresponding to four colors of yellow (Y), magenta (M), cyan (C), and black (K) are aligned to oppose an intermediate transfer belt 8. A secondary transfer roller 19 (contact unit) is arranged to oppose the intermediate transfer belt 8.

As shown in FIG. 2, the imaging unit 6Y includes a photosensitive element 1Y, a charging unit 4Y, a developing unit 5Y, a cleaning unit 2Y, and a neutralizing unit (not shown) arranged around the photosensitive element 1Y. An image forming process that includes charging, exposing, developing, transferring, and cleaning processes is performed on the photosensitive element 1Y to form a yellow image on the photosensitive element 1Y.

Other than the difference in the toner color, the other three imaging units 6M, 6C, and 6K have substantially the same structure as the yellow imaging unit 6Y, and form images of respective corresponding colors. In the following explanation, the description of the three imaging units 6M, 6C, and 6K is omitted, and the imaging unit 6Y is explained as a representative of the imaging units.

As shown in FIG. 2, the photosensitive element 1Y is driven to rotate counterclockwise by a drive motor (not shown), and the surface of the photosensitive element 1Y is uniformly charged at the position opposing the charging unit 4Y (charging process).

Thereafter, the charged surface of the photosensitive element 1Y reaches the position opposing an exposing unit 7, where the photosensitive element 1Y is scanned with a laser beam L emitted from the exposing unit 7, so that an electrostatic latent image corresponding to yellow is formed on the photosensitive element 1Y (exposing process).

Then, the surface portion of the photosensitive element 1Y on which the latent image is formed reaches a position opposing the developing unit 5Y, where the latent image is developed into a yellow toner image (developing process).

Then, the surface portion of the photosensitive element 1Y on which the toner image is formed reaches a position opposing the intermediate transfer belt 8 and a primary transfer roller 9Y (primary transfer roller), where the toner image is transferred onto the intermediate transfer belt 8 (primary transferring process). At this step, a very small amount of toner that fails to be transferred remains on the photosensitive element 1Y.

Then, the surface portion of the photosensitive element 1Y with the residual toner thereon reaches a position opposing the cleaning unit 2Y, where the residual toner is collected into the cleaning unit 2Y by a cleaning blade 2*a* (cleaning process).

Finally, the surface portion of the photosensitive element 1Y reaches a position opposing the neutralizing unit, where a residual charge is eliminated from the photosensitive element 1Y.

In this manner, the image forming process performed on the photosensitive element 1Y is completed.

The imaging units 6M, 6C, and 6K perform the image forming process in the same manner as the imaging unit 6Y. In other words, the laser beam L is emitted from the exposing unit 7 that is arranged above the imaging units 6M, 6C, and 6K to photosensitive elements 1M, 1C, and 1K. More specifically, the exposing unit 7 emits the laser beam L from the light source and irradiates each photosensitive element through optical elements while scanning the photosensitive element with the laser beam L by a polygon mirror that is driven to rotate.

Thereafter, the toner images of different colors formed on the corresponding photosensitive elements at the developing process are transferred and superimposed onto the intermediate transfer belt 8. A color image is thereby formed on the intermediate transfer belt 8.

The intermediate transfer belt 8 onto which the color image is formed reaches a contact position where it is in contact with the secondary transfer roller 19. At the contact position, a secondary transfer opposing roller 12B nips the intermediate transfer belt 8 with the secondary transfer roller 19, forming a secondary transfer nip. Then, a high voltage (secondary transfer bias) of a polarity opposite to that of the toner is applied to the secondary transfer roller 19. In this manner, the color image formed on the intermediate transfer belt 8 is transferred onto a recording medium P such as a printing sheet that is fed to the contact position (secondary transferring process). After this process, some toner that fails to be transferred onto the recording medium P remains on the intermediate transfer belt 8.

Thereafter, the intermediate transfer belt 8 reaches an intermediate transfer cleaning unit 10. At this position, the toner that is not transferred is removed from the intermediate transfer belt 8.

The transferring process performed on the intermediate transfer belt 8 is thereby completed.

The recording medium P brought to the position of the secondary transfer nip is fed from a sheet feeding unit 26 arranged at the bottom in the image forming apparatus 100 (or another sheet feeding unit arrange on the side of the main body of the image forming apparatus 100) by a sheet feeding roller 27 and a pair of registration rollers 28 as shown in FIG. 1.

More specifically, recording media P such as printing sheets are stacked and stored in the sheet feeding unit 26. When the sheet feeding roller 27 is driven to rotate counterclockwise in FIG. 1, the top recording medium P is fed between the registration rollers 28.

The recording medium P conveyed to the registration rollers 28 is suspended at the position of the roller nip of the registration rollers 28 that have stopped its rotation. Then, the registration rollers 28 are rotated in synchronization with the timing of the color image formed on the intermediate transfer belt 8, and the recording medium P is thereby conveyed to the position of the secondary transfer nip. Therefore, a desired color image is transferred onto the recording medium P.

Then, the recording medium P onto which the color image is transferred is conveyed to the position of a fixing unit 20. The color image transferred onto the surface of the recording medium P is fixed thereto by heat and pressure by a fixing roller and a pressing roller of the fixing unit 20.

Thereafter, the recording medium P is discharged from the main body of the image forming apparatus 100 by a pair of discharging rollers (not shown). The recording media P discharged by the discharging rollers are sequentially stacked on a stacking unit.

The image forming process in the image forming apparatus 100 is thereby completed.

The structure and operation of the developing unit 5Y in the imaging unit 6Y is now explained in detail with reference to FIG. 2.

The developing unit 5Y includes a developing roller 51Y that opposes the photosensitive element 1Y, a doctor blade 52Y that opposes the developing roller 51Y, conveying screws 55Y provided in a developer container, a toner supply pipe 43Y having an opening communicating with the developer container, and a density detection sensor 56Y that detects the density of toner in the developer. The developing roller 51Y includes a magnet fixed therein and a sleeve that rotates around the magnet. The developer container contains a two-component developer that consists of carrier and toner.

The developing unit 5Y having the above structure operates in the following manner.

The sleeve of the developing roller 51Y rotates in a direction as indicated by an arrow shown in FIG. 2. The developer carried on the developing roller 51Y by a magnetic field that is formed by the magnet moves on the developing roller 51Y as the sleeve rotates. The developer in the developing unit 5Y is adjusted so that the toner ratio (toner density) of the developer falls within a certain range.

Thereafter, the toner supplied to the developer container is mixed and stirred with the developer by the conveying screws 55Y, and is circulated between the two separate developer containers (in the vertical direction with respect to the drawing sheet of FIG. 2). The toner in the developer is attracted to the carrier by the frictional charge between the toner and the carrier, and carried together with the carrier on the developing roller 51Y by the magnetic force acting on the developing roller 51Y.

The developer held on the developing roller 51Y is carried in the direction indicated by the arrow shown in FIG. 2 to the position of the doctor blade 52Y. The developer on the developing roller 51Y is adjusted to a suitable amount by the doctor blade 52Y and then carried to the position opposing the photosensitive element 1Y (developing area). The toner is attracted to the latent image formed on the photosensitive element 1Y by an electric field formed in the developing area. As the sleeve rotates, the developer remaining on the developing roller 51Y is carried to the upper portion of the developer container, where it is removed from the developing roller 51Y.

The intermediate transfer device 15 is now explained in detail with reference to FIG. 3.

The intermediate transfer device 15 includes the intermediate transfer belt 8 (image carrier), primary transfer rollers 9Y, 9M, 9C, and 9K, a drive roller 12A, the secondary transfer opposing roller 12B as a contact target unit, a support roller 12C, a correction roller 12D, and the intermediate transfer cleaning unit 10. The intermediate transfer belt 8 is stretched and supported by the rollers 12A to 12D and is driven to endlessly move in accordance with the rotation of one of the rollers (drive roller 12A) in a direction indicated by the arrow shown in FIG. 3.

Each of the primary transfer rollers 9Y, 9M, 9C, and 9K (primary transfer rollers) forms a primary transfer nip together with the photosensitive elements 1Y, 1M, 1C, and 1K, respectively, with the intermediate transfer belt 8 sandwiched therebetween. A high voltage (transfer bias) having a polarity opposite to that of the toner is applied to the primary transfer rollers 9Y, 9M, 9C, and 9K.

The intermediate transfer belt 8 runs in the direction of the arrow and sequentially passes the primary transfer nips of the primary transfer rollers 9Y, 9M, 9C, and 9K. In this manner, the toner images of different colors formed on the photosensitive elements 1Y, 1M, 1C, and 1K are primarily transferred and superimposed on the intermediate transfer belt 8.

According to the present embodiment, the intermediate transfer belt 8 that serves as an image carrier is formed by preparing a single or multiple layers of polyvinylidene difluoride (PVDF), ethylene-tetrafluoro ethylene copolymer (ETFE), polyimide (PI), polycarbonate (PC), or the like and dispersing a conductive material such as carbon black dispersed therein. The intermediate transfer belt 8 is adjusted to have a volume resistivity of $10^7$ Ω·cm to $10^{12}$ Ω·cm and a surface resistivity of the back side of the belt of $10^8$ Ω/sq. to $10^{12}$ Ω/sq. Moreover, the thickness of the intermediate transfer belt 8 is determined in the range of 80 micrometers to 100 micrometers. According to the present embodiment, the thickness of the intermediate transfer belt 8 is 90 micrometers, and the circumferential length is 2197.5 millimeters.

A mold lubricant layer can be coated on the surface of the intermediate transfer belt 8, if necessary. As a coating material, a fluorocarbon resin can be adopted, such as ethylene-tetrafluoro ethylene copolymer (ETFE), polytetrafluoroethylene (PTFE), polyvinylidene difluoride (PVDF), perfluoro alkoxy fluorocarbon resin (PEA), tetrafluoro-ethylene hexafluoro-propylene copolymer (FEP), and polyvinyl fluoride (PVF), but it is not limited thereto.

The intermediate transfer belt 8 can be prepared by cast molding or centrifugal molding. The surface of the intermediate transfer belt 8 can be polished, as required.

The primary transfer rollers 9Y, 9M, 9C, and 9K are arranged to separate the intermediate transfer belt 8 from the photosensitive elements 1Y, 1M, 1C, and 1K.

More specifically, among the primary transfer rollers 9Y, 9M, 9C, and 9K, the primary transfer rollers 9Y, 9M, and 9C for color images are held as one unit in a housing (not shown) to move up and down as one unit. The primary transfer roller 9K for black is configured to individually move up and down. When the primary transfer rollers 9Y, 9M, 9C, and 9K move to the position indicated by the dashed line in FIG. 3, the intermediate transfer belt 8 is separated from the photosensitive elements 1Y, 1M, 1C, and 1K (moved to the dashed-lined position). The operation of separating the intermediate transfer belt 8 from the photosensitive elements 1Y, 1M, 1C, and 1K is performed to reduce the wearing down and deterioration of the intermediate transfer belt 8. The operation is performed mainly at the non-image forming time. The primary transfer black roller 9K is configured to be solely movable in a vertical direction because when forming a monochrome image, the other three primary transfer rollers 9Y, 9M, and 9C for color images can be moved downward so that the color-image photosensitive elements 1Y, 1M, and 1C can be separated from the intermediate transfer belt 8.

The drive roller 12A is driven to rotate by the drive motor. The intermediate transfer belt 8 thereby runs in a specific direction (clockwise in FIG. 3).

The secondary transfer opposing roller 12B is brought into contact with the secondary transfer roller 19, with the intermediate transfer belt 8 interposed therebetween. The support roller 12C is brought into contact with the outer surface of the intermediate transfer belt 8. The intermediate transfer cleaning unit 10 (cleaning blade) is arranged between the secondary transfer opposing roller 12B and the support roller 12C.

The correction roller 12D is configured to have one end fixed and the other end vertically movable (so that the rotational axis can incline) to cope with a displacement (displacement amount) of the intermediate transfer belt 8 that is detected by a detection sensor (not shown). In this manner, the displacement (serpentine movement) of the intermediate transfer belt 8 in its width direction is corrected.

The secondary transfer roller 19 is configured to be movable in a direction indicated by an up-down arrow shown in FIG. 3 to be separated from the secondary transfer opposing roller 12B by the (manual/automatic) contact/separation mechanism of a transfer device 30. The secondary transfer roller 19 is prepared by forming a rubber layer of nitrile rubber (NBR) or the like that has a hardness of 48 Hs to 58 Hs on a core metal. According to the present embodiment, the secondary transfer roller 19 has a length of 344 millimeters in the width direction (direction of the rotational axis).

A holding unit 36 of the transfer device 30 holds the secondary transfer roller 19, a blade 61 as a cleaning unit, a lubricant applying brush 62 as a lubricant applying unit, an neutralizing needle 63 as a neutralizing unit, and a paper-dust collecting brush 64 as a cleaning unit. The blade 61 is a plate member made of a rubber material, which is brought into contact with the secondary transfer roller 19 to mechanically remove toners and other adherents from the surface of the secondary transfer roller 19. The paper-dust collecting brush 64 is a brush roller formed by placing brush bristles around a core metal and remove paper dust and other adherents from the surface of the secondary transfer roller 19 by bringing the brush bristles into contact with the secondary transfer roller 19. The neutralizing needle 63 is arranged to oppose the secondary transfer roller 19. When a certain voltage is applied to the secondary transfer roller 19, the neutralizing needle 63 neutralizes the surface of the secondary transfer roller 19. The lubricant applying brush 62 is brought into contact with a solid lubricant that is pressed by a spring and also with the secondary transfer roller 19 and thereby supplies the scraped portion of the solid lubricant onto the secondary transfer roller 19. The lubricant on the secondary transfer roller 19 is supplied also to the intermediate transfer belt 8, which increases the wear resistance of the intermediate transfer belt 8 and the secondary transfer roller 19.

The pressing mechanism of the transfer device 30, which presents the characteristic feature of the image forming apparatus 100 according to the present embodiment, is now explained with reference to FIGS. 4 to 7D.

Figure 4:
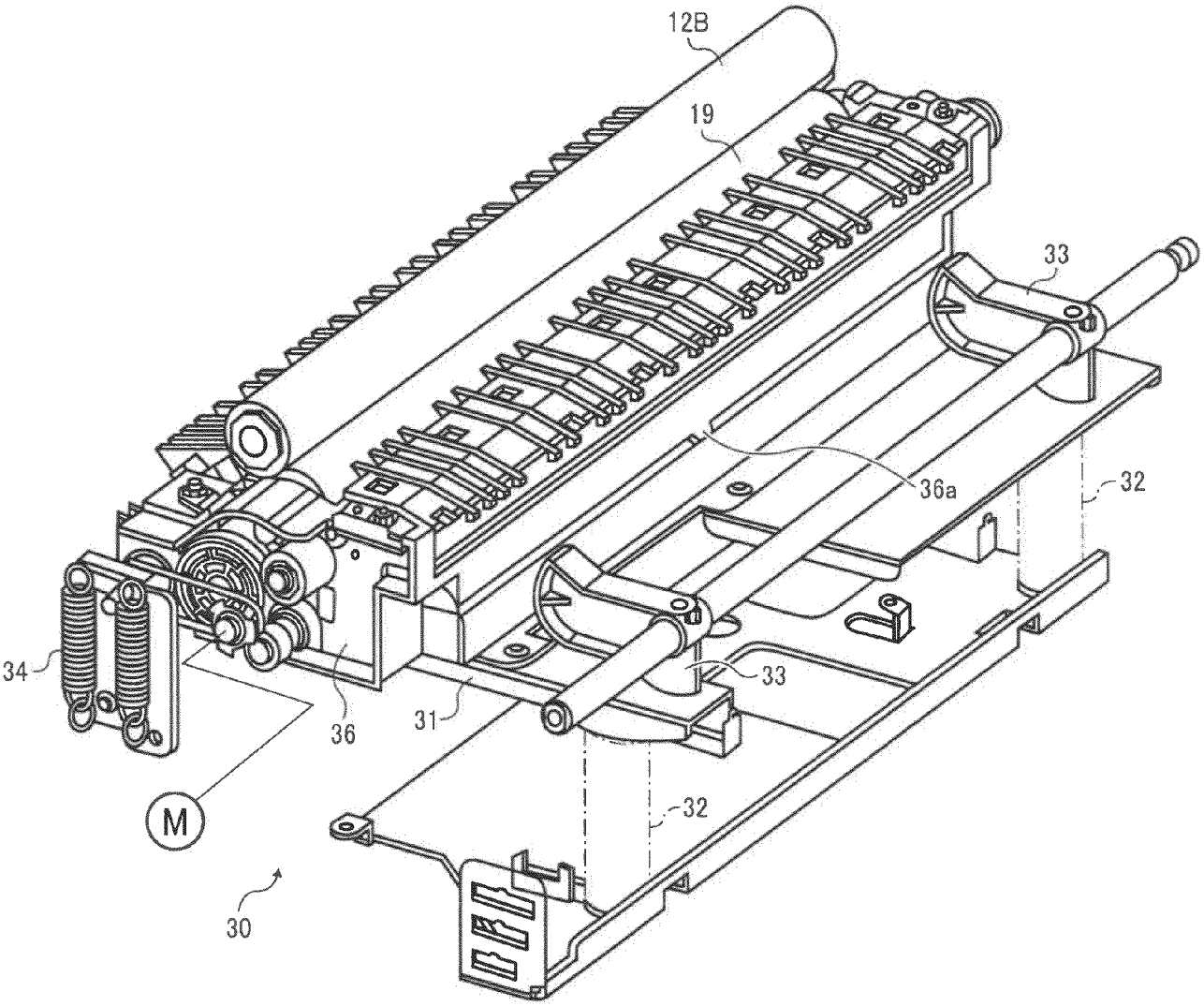
FIG. 4 is a perspective view of a transfer device shown in FIG. 3.
Figure 5:
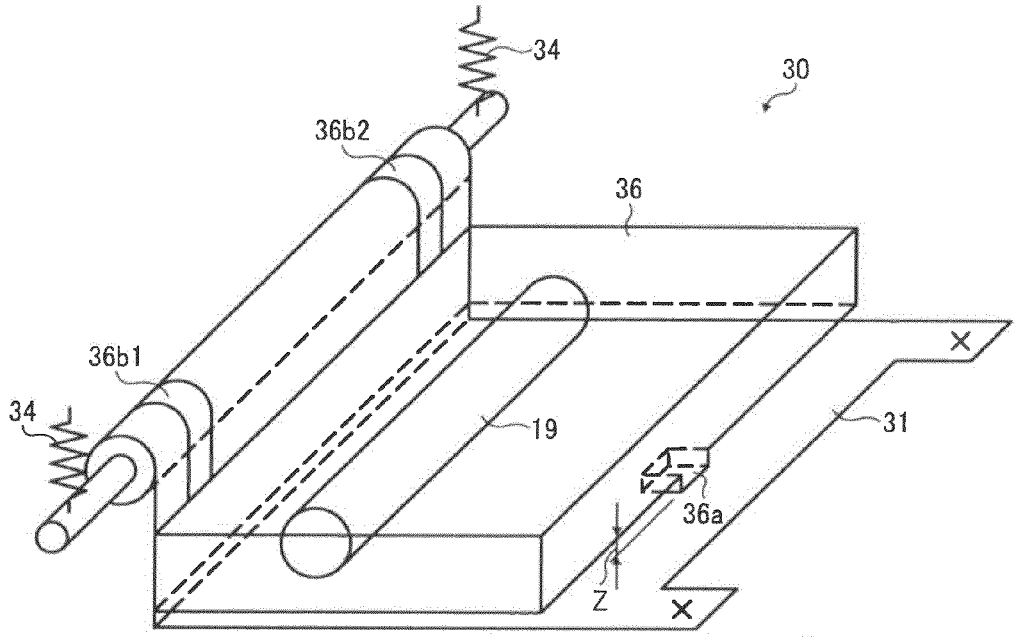
FIG. 5 is a perspective view of a pressing mechanism of the transfer device.
Figure 6:
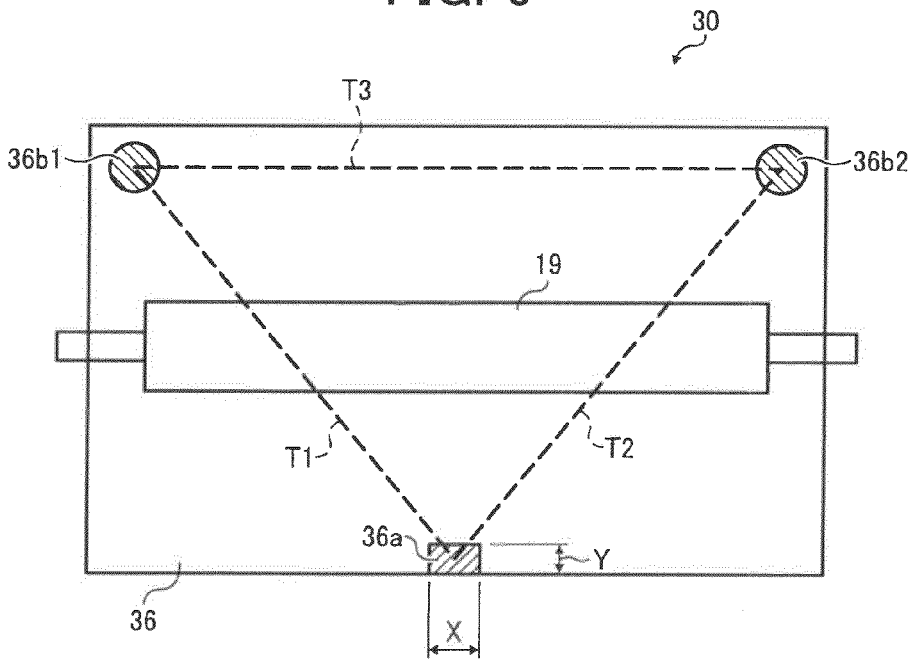
FIG. 6 is a schematic diagram of the pressing mechanism viewed from the top.

FIG. 4 is a perspective view of the transfer device 30. FIG. 5 is a perspective view for schematically showing the pressing mechanism of the transfer device 30, and FIG. 6 is a schematic diagram of the pressing mechanism of the transfer device 30 viewed from the top. FIGS. 7A to 7D are schematic diagrams for explaining the contact/separation operations of the transfer device 30.

An automatic cam 35 (second cam unit), the intermediate transfer belt 8, and first springs 34 on the other side are omitted in FIG. 4. In FIGS. 7A to 7D, the first springs 34 are represented by a compressed spring for simplicity.

Figure 7A:
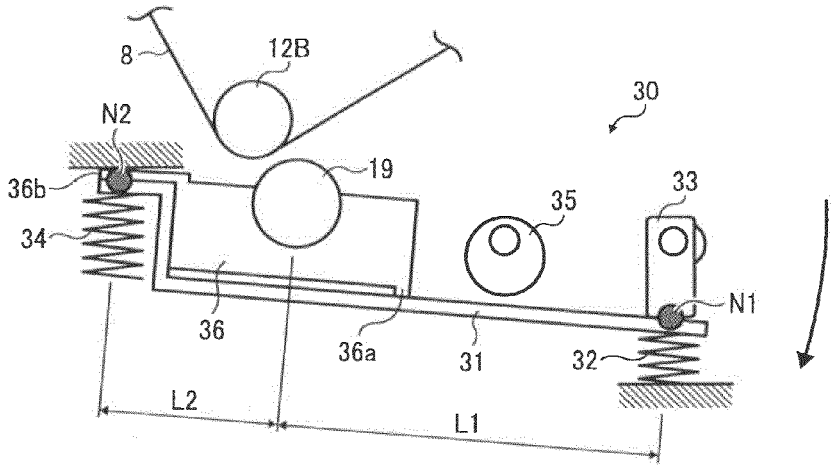
FIGS. 7A to 7C are schematic diagrams for explaining contact/separation operations of the transfer device.
Figure 7B:
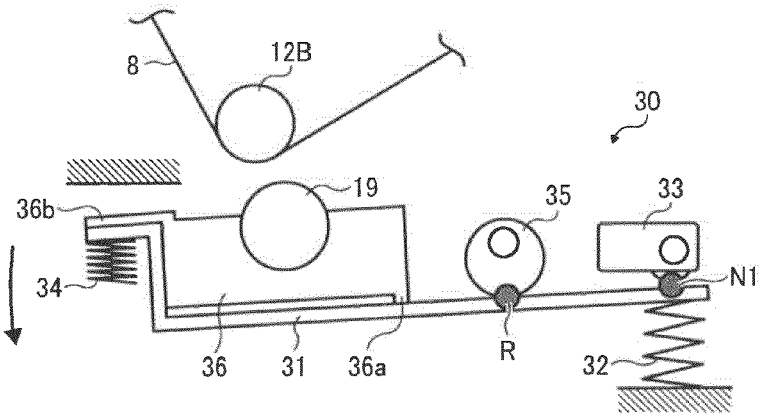
Figure 7C:
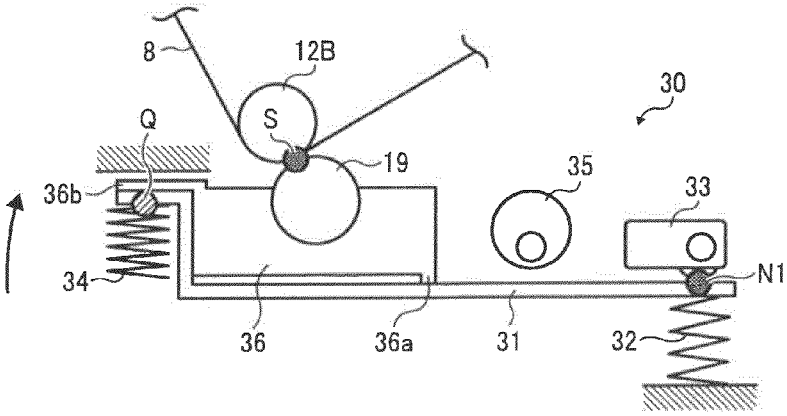

In a normal mode, the secondary transfer roller 19 is pressed against the secondary transfer opposing roller 12B by the pressing mechanism of the transfer device 30, with the intermediate transfer belt 8 interposed therebetween (FIGS. 3, 4, and 7C).

The transfer device 30 includes the contact/separation mechanism and the pressing mechanism. The contact/separation mechanism functions as a manual contact/separation mechanism that manually separates the secondary transfer roller 19 that is in pressure contact with the intermediate transfer belt 8 from the intermediate transfer belt 8 (secondary transfer opposing roller 12B). The contact/separation mechanism functions also as an automatic contact/separation mechanism that automatically separates the secondary transfer roller 19 from the intermediate transfer belt 8 (secondary transfer opposing roller 12B) under the control of the image forming apparatus 100. The automatic contact/separation mechanism is controlled so that the secondary transfer roller 19 is separated from the intermediate transfer belt 8, for example, when the secondary transfer is not performed. The manual contact/separation mechanism is manipulated by the user or a service person when the image forming apparatus 100 is powered off and when it is necessary to manually separate the secondary transfer roller 19 from the intermediate transfer belt 8.

As shown in FIGS. 4, 5, and 7A to 7C, the pressing mechanism (contact/separation mechanism) includes the holding unit 36 holding the secondary transfer roller 19, a pressing plate 31 as a pressing member, a manual cam 33 as a first cam unit, the automatic cam 35 as a second cam unit, the first springs 34 and second springs 32 as biasing units.

The pressing plate 31 is configured to rotate together with the holding unit 36 that holds the secondary transfer roller 19 (at both manual and automatic contact/separation operations). The holding unit 36 is shaped substantially into a box. The holding unit 36 holds the blade 61, the lubricant applying brush 62, the neutralizing needle 63, and the paper-dust collecting brush 64 in addition to the secondary transfer roller 19, as explained with reference to FIG. 3. Moreover, the holding unit 36 holds a driving unit (including gear trains, a timing belt, a pulley, and the like) for transmitting a driving force to the secondary transfer roller 19, a guide plate that guides the recording medium P to the secondary transfer nip, and the like. Such an arrangement makes the holding unit 36 heavy in weight.

In the manual contact/separation operations, the pressing plate 31 turns about a second fulcrum N2 positioned in the vicinity of the secondary transfer roller 19. In the automatic contact/separation operations, the pressing plate 31 turns about a first fulcrum N1 positioned away from the secondary transfer roller 19. These operations will be described later in detail with reference to FIGS. 7A to 7C.

The manual cam 33 separates from the intermediate transfer belt 8 the secondary transfer roller 19 that is brought into pressure contact with the intermediate transfer belt 8 (secondary transfer opposing roller 12B). The manual cam 33 is configured to turn about the shaft together with a manual lever that is not shown. The user or the service person manipulates the manual lever to turn the manual cam 33 around and separate the secondary transfer roller 19. Then, a recording medium remaining in the secondary transfer nip (paper jam) can be removed, or maintenance of the secondary transfer roller 19 and the intermediate transfer device 15 can be performed.

As shown in FIGS. 7A to 7C, the manual cam 33 is positioned away from the secondary transfer roller 19 and brought into contact with the pressing plate 31 at the position of the first fulcrum N1 that serves as the rotary fulcrum of the automatic contact/separation operations. The second spring 32 is arranged to bias the pressing plate 31 upward at the position of the first axis.

As shown in FIGS. 7A to 7C, the automatic cam 35 connected to the drive motor is configured to rotate eccentrically about the shaft. The automatic cam 35 is arranged between the first fulcrum N1 and the secondary transfer roller 19 in such a manner as to be brought into contact with and separated from the pressing plate 31.

As shown in FIG. 5, the first springs 34 are arranged at positions away from the secondary transfer roller 19 (but relatively close to the secondary transfer roller 19) at both ends in the width direction (the axial direction of the secondary transfer roller 19). The first springs 34 bias the holding unit 36 upward, together with the pressing plate 31 to press the secondary transfer roller 19 against the intermediate transfer belt 8.

The holding unit 36 that holds the secondary transfer roller 19 is provided with the first springs 34, and is supported by the pressing plate 31 that moves in a direction in which the secondary transfer roller 19 is brought into contact with or separated from the secondary transfer opposing roller 12B in accordance with the rotation of the cams 33 and 35.

More specifically, as shown in FIGS. 5 and 6, the holding unit 36 is supported at three points on the pressing plate 31 by a supporting portion 36*a* and two biasing portions 36*b*1 and 36*b*2.

The two biasing portions 36*b*1 and 36*b*2 are positioned at both end portions of the holding unit 36 in its width direction and away from the secondary transfer roller 19. The biasing portions 36*b*1 and 36*b*2 are shaped into arms that are engaged with the shaft of the pressing plate 31 on which the first springs 34 are positioned. With such an arrangement, the biasing portions 36*b*1 and 36*b*2 are biased toward the secondary transfer opposing roller 12B by the first springs 34.

The supporting portion 36*a* is positioned at the center of the holding unit 36 in its width direction and arranged across the secondary transfer roller 19 from the biasing portions 36*b*1 and 36*b*2. According to the present embodiment, the supporting portion 36*a* is shaped into a rectangular solid extruding downward from the holding unit 36, of 3 millimeters long in the X direction (width direction), 1.6 millimeters long in the Y direction (recording medium feeding direction), and 1 millimeter long in the Z direction (height direction). By determining the size of the supporting portion 36*a* to be suitably large, the considerably heavy holding unit 36 can be reliably supported. The supporting portion 36*a* according to the present embodiment is shaped into a rectangular solid, but the shape is not limited thereto. For example, the supporting portion 36*a* can be shaped into a hemisphere.

According to the present embodiment, the holding unit 36 that holds the secondary transfer roller 19 is biased toward the secondary transfer opposing roller 12B at the end portions in the width direction that are away from the secondary transfer roller 19. The holding unit 36 is also supported at its center in the width direction on the other side of the biased side, away from the secondary transfer roller 19. Thus, the secondary transfer roller 19 can be pressed evenly against the secondary transfer opposing roller 12B. In other words, pressure applied onto the secondary transfer roller 19 in its width direction against the secondary transfer opposing roller 12B is prevented from becoming uneven. Thus, even if the image forming apparatus is of a large type with a large width and a large maximum sheet feeding width, the secondary transfer roller 19 is prevented from causing uneven transfer of a toner image onto the recording medium P. The density of the output image is therefore prevented from becoming uneven in the width direction (perpendicular to the recording medium feeding direction).

According to the present embodiment, as shown in FIG. 6, the biasing portions 36*b*1 and 36*b*2 and the supporting portion 36*a* are arranged in such a manner that a virtual plane formed by connecting these units (the plane indicated by dashed lines in the drawing) becomes approximately an isosceles triangle with a virtual line segment T3 between the biasing portions 36*b*1 and 36*b*2 being the base. In other words, the three units are arranged so that a virtual line segment T1 connecting the biasing portion 36*b*1 and the supporting portion 36*a* has substantially the same length as a virtual line segment T2 connecting the biasing portion 36*b*2 and the supporting portion 36*a*.

With such an arrangement, the secondary transfer roller 19 can be pressed still more evenly against the secondary transfer opposing roller 12B, and thus uneven application of pressure can be reliably suppressed in the width direction of the secondary transfer roller 19 that is brought into pressure contact with the secondary transfer opposing roller 12B.

According to the present embodiment, the application of pressure per unit length onto the secondary transfer roller 19 (determined to be 344 millimeters long in the width direction) against the secondary transfer opposing roller 12B is set to 0.14 N/mm to 0.20 N/mm. More specifically, the force of the first springs 34 is determined to satisfy this condition.

Furthermore, $A \times 2/B \leqq 0.22$ is satisfied, where A [N] is a difference between pressures on both ends of the secondary transfer roller 19 in the width direction against the secondary transfer opposing roller 12B, and B [N] is a total sum of the pressures onto the both ends of the secondary transfer roller 19 in the width direction against the secondary transfer opposing roller 12B.

More specifically, because the biasing portions 36*b*1 and 36*b*2 and the supporting portion 36*a* that support the holding unit 36 at three points on the pressing plate 31 are arranged to form substantially an isosceles triangle, as explained above, the unevenness of the pressure onto the secondary transfer roller 19 against the secondary transfer opposing roller 12B can be kept within the above range.

Hence, the quality of the toner image transferred onto the recording medium P by the secondary transfer roller 19 can be improved, without developing significant unevenness of the density in the width direction of the output image.

The manual and automatic contact/separation operations of the transfer device 30 are explained with reference to FIGS. 7A to 7C.

As shown in FIG. 7A, the position of the first springs 34 serve as the rotational center (second fulcrum N2), and the manual and automatic contact/separation mechanism of the transfer device 30 manually separates the secondary transfer roller 19 from the intermediate transfer belt 8 by turning the pressing plate 31 together with the secondary transfer roller 19 (the holding unit 36) about the second fulcrum N2. More specifically, when the user or the like manipulates the manual lever, the manual cam 33 turns counterclockwise to push the pressing plate 31 down. Then, the first springs 34 pushes one end of the pressing plate 31 (second fulcrum N2) up into contact with the ceiling surface, and the pressing plate 31 turns about the second fulcrum N2, lowering the position of the first fulcrum N1 against the biasing force of the second spring 32. In this manner, the secondary transfer roller 19 is manually separated.

When the secondary transfer roller 19 is in the position of FIG. 7A and the manual level is manipulated to rotate the manual cam 33 clockwise, the pressing plate 31 turns with the second fulcrum N2 serving as a rotary fulcrum. Then, the secondary transfer roller 19 returns to the state of FIG. 7B (or FIG. 7C) (i.e., the state in which the automatic contact/separation operations can be performed).

In the manual operation of the contact/separation mechanism, because the point of application of force (the manual cam 33) is positioned sufficiently away from the second fulcrum N2 (or the secondary transfer roller 19), the spring force of the second spring 32 is reduced. This reduces the force (manipulation force) required to turn the manual cam 33 around. In other words, the operability of manually separating the secondary transfer roller 19 is improved.

The automatic contact/separation operations of the transfer device 30 are performed when the manual cam 33 is in the position of FIGS. 7B and 7C so that the position of the first fulcrum N1 is fixed by the manual cam 33 and the second spring 32.

More specifically, as shown in FIG. 7B, when the secondary transfer roller 19 is to be automatically separated, the automatic cam 35 rotates by a certain angle until it comes into contact with the pressing plate 31 at position R. Therefore, the pressing plate 31 turns counterclockwise, together with the secondary transfer roller 19 (the holding unit 36), around the first fulcrum N1 against the force of the first springs 34.

As shown in FIG. 7C, when the secondary transfer roller 19 is to be automatically brought into contact with the intermediate transfer belt 8, the automatic cam 35 rotates by a certain angle until it is separated from the pressing plate 31. Therefore, the pressing plate 31 rotates clockwise, together with the secondary transfer roller 19 (the holding unit 36), around the first fulcrum N1 under the force of the first springs 34, which brings the secondary transfer roller 19 and the intermediate transfer belt 8 into contact with each other and stop at the secondary transfer nip S. In this state, the end portions Q (the biasing portions 36*b*1 and 36*b*2) of the pressing plate 31 to which the first springs 34 are connected are not in contact with the ceiling surface.

Because the rotary fulcrum (the first fulcrum N1) for the automatic contact/separation operation mechanism is positioned sufficiently away from the secondary transfer roller 19, this arrangement suppresses unevenness in the pressure in the width direction (the perpendicular direction with respect to the sheet of FIGS. 7A to 7C) of the secondary transfer roller 19 that is in pressure contact with the intermediate transfer belt 8, even when the secondary transfer roller 19 and the rotary fulcrum (shaft) are not exactly parallel to each other (i.e. the alignment accuracy is insufficient). As a result, inconsistencies in transfer in the width direction are reduced during the secondary transfer process.

The manual and automatic contact/separation mechanism of the transfer device 30 can be downsized because the automatic cam 35 is arranged between the first fulcrum N1 and the secondary transfer roller 19.

The contact/separation mechanism according to the present embodiment is configured to switch between the rotary fulcrum (the first fulcrum N1) of the pressing plate 31 for pressing the secondary transfer roller 19 to bring it into contact with the intermediate transfer belt 8 and the rotary fulcrum (second fulcrum N2) of the pressing plate 31 for manually bringing the secondary transfer roller 19 into contact with the intermediate transfer belt 8 and separating the secondary transfer roller 19 from the intermediate transfer belt 8. Thus, a distance L1 between the rotary fulcrum for pressing (first fulcrum N1) and the secondary transfer roller 19 is determined to be sufficiently long, which also means that the distance L1 between the point of application for the manual operation (the first fulcrum N1) and the secondary transfer roller 19 is sufficiently long. Hence, the operability in the manual contact/separation operations is improved and, at the same time, unevenness in pressure applied to the secondary transfer roller 19 against the intermediate transfer belt 8 is reduced.

To ensure the above effects, the secondary transfer roller 19 should be provided between the first fulcrum N1 and the second fulcrum N2, and the distance L1 between the secondary transfer roller 19 and the first fulcrum N1 should be longer than a distance L2 between the secondary transfer roller 19 and the second fulcrum N2 (L1>L2). More specifically, the distance L1 should be two to three times (preferably two to five times) greater than the distance L2.

Figure 8A:
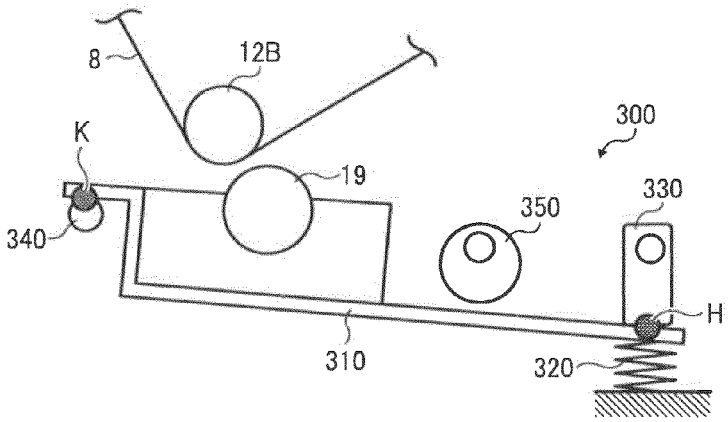
FIGS. 8A to 8C are schematic diagrams for explaining the operation by a conventional contact/separation mechanism.
Figure 8B:
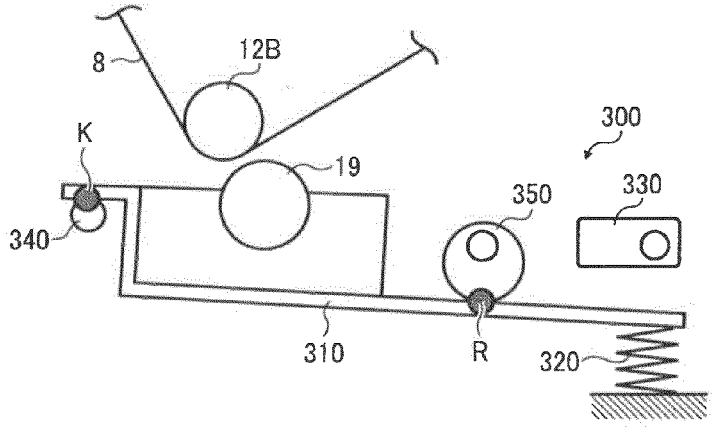
Figure 8C:
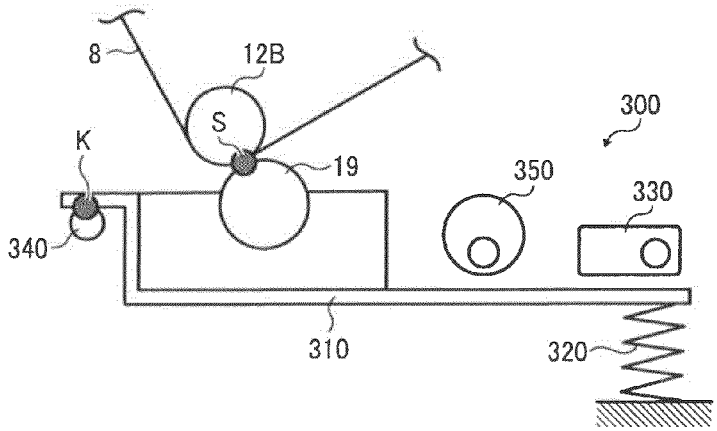

Problems that may arise if there is no switching between a rotary fulcrum K of a pressing plate 310 for pressing the secondary transfer roller 19 against the intermediate transfer belt 8 and a rotary fulcrum K of the pressing plate 310 for manually bringing the secondary transfer roller 19 into contact with the intermediate transfer belt 8 and separating the secondary transfer roller 19 from the intermediate transfer belt 8 are considered with reference to FIGS. 8A to 8C.

As shown in FIG. 8A, during the manual operation, a manual cam 330 is turned counterclockwise to push the pressing plate 310 down against the spring force of a compression spring 320. The manual cam 330 and the compression spring 320 are positioned sufficiently away from the secondary transfer roller 19, and thus the power required for the manual contact/separation operations can be reduced.

On the other hand, during the automatic contact/separation operations as shown in FIGS. 8B and 8C, an automatic cam 350 comes into contact with or is separated from the pressing plate 310 while the manual cam 330 is not in contact with the pressing plate 310. Thus, the pressing plate 310 turns about the rotary fulcrum K, together with the secondary transfer roller 19, to automatically bring the secondary transfer roller 19 into contact with the intermediate transfer belt 8 or separate the secondary transfer roller 19 from the intermediate transfer belt 8. Because a rotational shaft 340 is provided in the vicinity of the secondary transfer roller 19, the pressure on the secondary transfer roller 19 that is brought into contact with the intermediate transfer belt 8 tends to become considerably uneven when the secondary transfer roller 19 and the rotational shaft 340 are not exactly parallel to each other.

According to the present embodiment, the holding unit 36 that holds the secondary transfer roller 19 is biased toward the secondary transfer opposing roller 12B at the positions of the both end portions of the holding unit 36 in its width direction that are away from the secondary transfer roller 19. Furthermore, the holding unit 36 is also supported at its center portion in the width direction on the opposite side of the biased side, away from the secondary transfer roller 19. Hence, the problem of uneven pressure in the width direction that is applied to the secondary transfer roller 19 brought into contact with the secondary transfer opposing roller 12B can be avoided with a relatively simple structure.

According to the present embodiment, the invention is applied to the pressing mechanism that adapts the secondary transfer opposing roller 12B for a contact unit and the secondary transfer roller 19 for a contact target unit. The application of the invention is not limited thereto, however. The present invention is applicable to any pressing mechanism for pressing the contact unit that is brought into contact with the contact target unit in a separable manner, and such an application can produce the same effects as the present embodiment does.

According to the present embodiment, the invention is applied to the transfer device 30 that secondary-transfers a toner image onto the recording medium P. The invention can be also applied to a transfer device that primary-transfers a toner image onto an image carrier such as the intermediate transfer belt 8. The present invention can be applied to a transfer device incorporated in a monochrome image forming apparatus, which transfers a toner image carried on an image carrier such as a photosensitive element to a recording medium. These applications can also produce similar effects to the present embodiment.

The present invention is not limited to the above embodiment. In addition to the above description, the embodiment can be suitably modified without departing from the scope of the invention. The numbers, positions, shapes of the structural components are not limited to the present embodiment, and any suitable number, position, and shape can be adopted to realize the present invention.

According to an aspect of the preset invention, it is possible to provide a pressing mechanism, a transfer device, and an image forming apparatus capable of suppressing unevenness in pressure applied from a contact unit to a contact target unit in a width direction with a relatively simple structure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device that transfers a toner image from a first image carrier onto either one of a recording medium and a second image carrier, the transfer device comprising:

a transfer roller;

a pressing mechanism that presses the transfer roller that is brought into contact with a contact target, a holding unit that holds the transfer roller, the holding unit including:

two first portions being arranged at both ends of the holding unit in its width direction away from the transfer roller and being biased toward the contact target unit and supporting the holding unit; and a second portion being arranged at another end being opposite to the ends of the holding unit on which the first portions are positioned, and at approximately a center in the width direction between the first portions and supporting the holding unit, wherein the pressing mechanism includes a first fulcrum that is further from the transfer roller than a second fulcrum.

2. The transfer device according to claim 1, wherein a pressure of the transfer roller applied to the contact target is from 0.14 N/mm to 0.20 N/mm.

3. The transfer device according to claim 1, wherein $A \times 2/B \leqq 0.22$ is satisfied, where A is a difference between pressures on both ends of the transfer roller in the width direction against the contact target unit in Newtons, and B is a total sum of the pressures in Newtons.

4. The transfer device according to claim 1, further comprising:

a cleaning unit that cleans a surface of the transfer roller;

a lubricant applying unit that applies a lubricant to the surface of the transfer roller; and a neutralizing unit that neutralizes the surface of the transfer roller, wherein the holding unit holds the transfer roller and at least one of the cleaning unit, the lubricant applying unit, and the neutralizing unit.

5. The transfer device according to claim 1, wherein the transfer roller includes a rubber layer having a rubber hardness of 48 Hs to 58 Hs.

6. The transfer device according to claim 1, further comprising:

an intermediate transfer belt; and a secondary transfer opposing roller, wherein the contact target is the intermediate transfer belt which is disposed between the transfer roller and the secondary transfer opposing roller.

7. The transfer device according to claim 1, further comprising:

a pressing unit that includes a biasing unit and moves in a direction in which the transfer roller is brought into contact with and separated from the contact target unit by a rotation of a cam, wherein the holding unit is supported on the pressing unit.

8. An image forming apparatus comprising the transfer device according to claim 1.

9. The transfer device according to claim 1, wherein the first portions and the second portion are configured such that a virtual plane formed by connecting the first portions and the second portion is an isosceles triangle with a virtual line connecting the first portions being a base of the isosceles triangle.

10. The transfer device according to claim 1, wherein the pressing mechanism comprises:

three positions to apply biasing forces.

11. The transfer device according to claim 10, wherein the pressing mechanism comprises:

three springs which apply the biasing forces at the three positions.

* * * * *